US007735809B2

(12) United States Patent
Maire

(10) Patent No.: US 7,735,809 B2
(45) Date of Patent: Jun. 15, 2010

(54) PULLEY

(75) Inventor: Paul R. Maire, Snowmass, CO (US)

(73) Assignee: Tie Boss LLC, Minneapolis, MN (US)

( * ) Notice: Subject to any disclaimer, the term of this patent is extended or adjusted under 35 U.S.C. 154(b) by 0 days.

(21) Appl. No.: 12/418,842

(22) Filed: Apr. 6, 2009

(65) Prior Publication Data

US 2010/0032632 A1 Feb. 11, 2010

Related U.S. Application Data

(60) Provisional application No. 61/042,333, filed on Apr. 4, 2008.

(51) Int. Cl.
*B66D 3/08* (2006.01)

(52) U.S. Cl. ..... 254/396; 254/399; 254/402; 254/405; 24/129 R; 24/130

(58) Field of Classification Search ..... 254/390, 254/394, 396, 397, 398, 399, 401, 402, 403, 254/405, 410, 411; 24/130, 129 R
See application file for complete search history.

(56) References Cited

U.S. PATENT DOCUMENTS 4,120,077 A * 10/1978 Fink ..... 24/130
4,541,615 A * 9/1985 King, Jr. ..... 254/134.3 FT
4,719,668 A * 1/1988 Cavanagh ..... 24/68 F
5,201,496 A * 4/1993 Bradette et al. ..... 254/405
6,094,783 A * 8/2000 Parsons ..... 24/130
7,380,771 B1 * 6/2008 Joy et al. ..... 254/394
7,428,769 B2 * 9/2008 Fontaine et al. ..... 24/130
7,562,862 B1 * 7/2009 Jackson ..... 254/376

* cited by examiner

*Primary Examiner*—Emmanuel M Marcelo
(74) *Attorney, Agent, or Firm*—Fredrikson & Byron, P.A.

(57) ABSTRACT

Embodiments of the present invention provide pulley apparatuses that can be easily incorporated into block-and-tackle configurations. In some embodiments, a rope can be easily dropped into place and removed, rather than having to be threaded in. For example, the pulley housing can include a rope channeling structure near the end opposite the aperture, and the rope channeling structure can facilitate introducing the rope into engagement with the wheel and/or removing the rope from engagement with the wheel. In some embodiments, the rope channeling structure can prevent the rope from inadvertently becoming removed from the pulley. Some pulley apparatuses can comprise a minimal number of parts, which can significantly simplify the manufacturing process and provide for a more consistent final product.

27 Claims, 6 Drawing Sheets

PULLEY

TECHNICAL FIELD

This document relates to various pulley apparatuses and, more particularly, to pulley apparatuses that can be used in block-and-tackle configurations (as well as the associated configurations, methods, kits, etc.).

BACKGROUND

There are many situations in which relatively heavy objects must be lifted and/or suspended (and/or lowered under control). For example, hunters must often suspend heavy animals (e.g., from a tree) for cleaning purposes; furniture and other heavy objects must be loaded onto trucks; trunks/crates must be moved to attics or garage lofts; portions of smaller vehicles (e.g., ATVs) must be lifted for purposes of changing a tire or pulled out of a stuck situation; and so on. In many instances, even a strong individual is unable to lift the objects in the desired manner.

The same can hold true when someone wants to introduce an optimum amount of tension in a line of some sort. For example, during the construction of a barbed-wire fence, the wire must be pulled tight to create a viable fence. Pulling the wire tight can be difficult or impossible for even a strong individual.

One mechanism that can aid in lifting such objects and/or pulling such objects tightly is a block-and-tackle configuration. Block-and-tackles involve arranging one or more pulleys in relation to a fixed object and feeding rope through the pulleys in such a way as to create a mechanical advantage. In this way, by pulling the rope over a longer distance, a greater lifting force can be achieved.

In many instances, configuring a block-and-tackle can present difficulties. Feeding the rope through the pulley(s) and/or attaching the load to the block-and-tackle can pose challenges that limit the usefulness and/or applicability of block-and-tackles.

SUMMARY

Embodiments of the present invention provide pulley apparatuses that can be easily incorporated into block-and-tackle configurations. In some embodiments, the pulley can be fixed via its hook and/or via its aperture. In some embodiments, a rope can be easily dropped into place and removed, rather than having to be threaded in. For example, the pulley housing can include a rope channeling structure near the end opposite the aperture, and the rope channeling structure can facilitate introducing the rope into engagement with the wheel and/or removing the rope from engagement with the wheel. In some embodiments, the rope channeling structure can prevent the rope from inadvertently becoming removed from the pulley. In some embodiments, the pulley can be hung by the aperture, the hook, or both. In some embodiments, the hook can be weighted such that it always hangs down (unless otherwise acted upon). In some embodiments, the hook can be oriented at various angles relative to the aperture (e.g., 180 degrees, 90 degrees, etc.). In some embodiments, the wheel's axle and the hook can be integrally formed of the same material. Some such embodiments can result in increased strength, improved performance, and/or reduced manufacturing costs.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION

The following detailed description is illustrative in nature and is not intended to limit the scope, applicability, or configuration of the invention in any way. Rather, the following description provides practical illustrations for implementing exemplary embodiments of the present invention. Examples of constructions, materials, dimensions, and manufacturing processes are provided for selected elements, and all other elements employ that which is known to those of ordinary skill in the field of the invention. Those of ordinary skill in the art will recognize that many of the examples provided have suitable alternatives that can be utilized.

Figure 1:
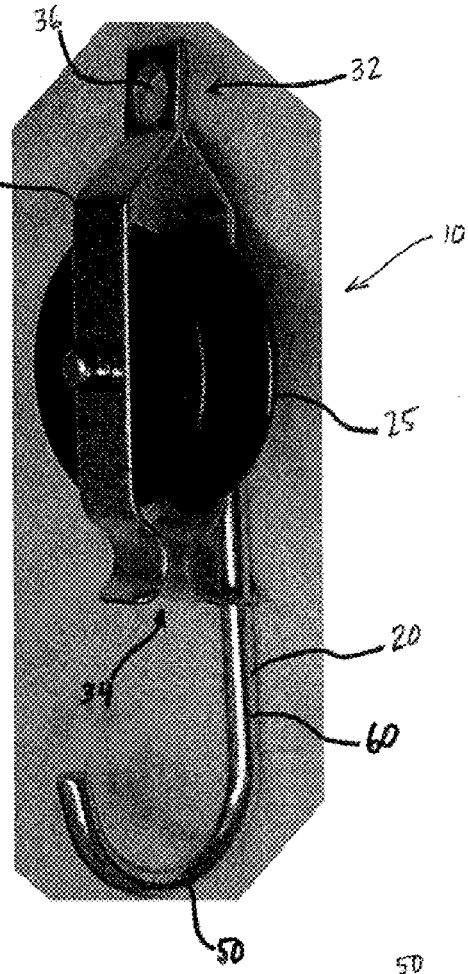
FIG. 1 is an isometric view of a pulley apparatus according to embodiments of the present invention.
Figure 2:
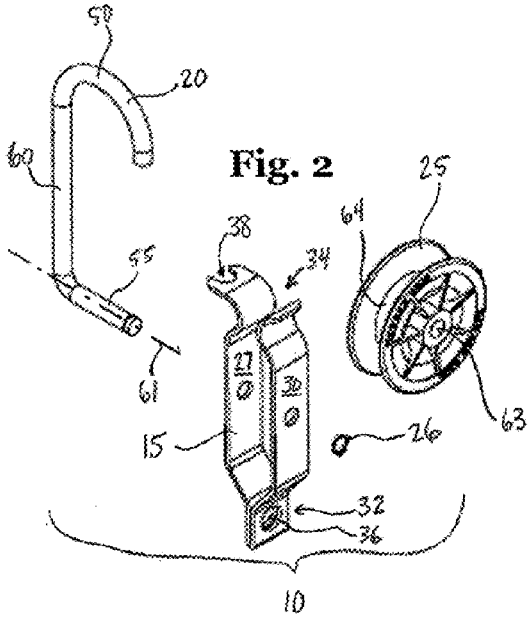
FIG. 2 is an exploded view of the pulley apparatus of FIG. 1.
Figure 3:
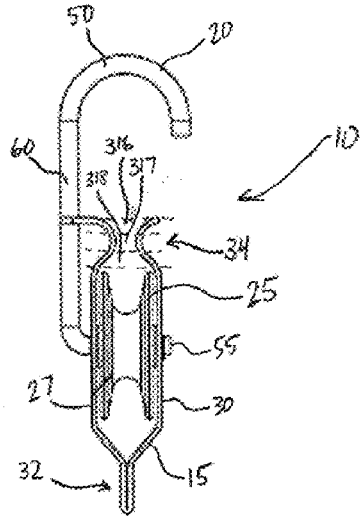
FIG. 3 is a side view of the pulley apparatus of FIG. 1.

FIGS. 1-3 show a pulley apparatus 10 according to embodiments of the present invention. As shown, the pulley apparatus 10 includes a support structure 15, a hook assembly 20, a wheel 25. Some embodiments can include a clipping mechanism 26 for securing the support structure 15 with the hook assembly 20. In some embodiments, the pulley apparatus 10 can assist in raising and/or lowering objects by providing a mechanical advantage, as is discussed in greater detail elsewhere herein. The pulley apparatus 10 of FIG. 1 comprises only four parts, which can significantly simplify the manufacturing process and provide for a more consistent final product.

The support structure 15 of the pulley apparatus 10 can support the other components of the pulley apparatus 10. In some embodiments, the support structure 15 can include first and second opposed end sections 32, 34, along with first and second opposed side members 27, 30 extending between the first and second end sections 32, 34. In many embodiments, the first and second opposed side members 27, 30 include substantially solid panels. In some embodiments, all of the support structure 15 is integrally formed of the same material. In such embodiments, the support structure 15 can be a strip of sheet metal bent into a desired shape. In many embodiments, the first end section 32 of the support structure defines an aperture 36. In many embodiments, the portion of the first end section 32 that defines the aperture 36 is generally parallel to the first and second opposed side members 27, 30. In some embodiments, the portion of the first end section 32 that defines the aperture 36 is generally perpendicular to the first and second opposed side members 27, 30 (e.g., with the first end section 32 being twisted 90 degrees). As is discussed in greater detail elsewhere herein, in some embodiments, the support structure 15 can include a hook assembly anchor 38.

FIGS. 4A-4D show a pulley apparatus 410 like that of FIGS. 1-3 in connection with a length of rope 412 to illustrate how the rope 412 can be inserted into the pulley apparatus 410. The pulley apparatus 410 has a support structure 415, which has a second end section 434. As shown, in certain preferred embodiments, the second end section 434 can include a rope channeling structure 440. The rope channeling structure 440 can assist in inserting rope 412 into the pulley apparatus 410, as well as inhibiting rope 412 already inserted from being accidentally removed from the pulley apparatus 410. The rope channeling structure 440 can include a first segment 442 extending from the first side member 427 and a second segment 444 extending from the second side member 430. The first and second segments 442, 444 can together define an entrance portion, an exit portion, and a narrower restrictor portion. FIG. 3 shows the entrance portion 316, the restrictor portion 317, and the exit portion 318 defined by the pulley apparatus 10 of FIGS. 1-3. Referring to FIGS. 4A-4D, in some embodiments, the first and second segments 442, 444 of the rope channeling structure 434 curve toward one another from the respective side members 427, 430 in defining the exit portion and curve back away from one another in defining the entrance portion. In some such embodiments, the restrictor portion can include a location at which the first segment 442 is nearest the second segment 444.

Figure 4A:
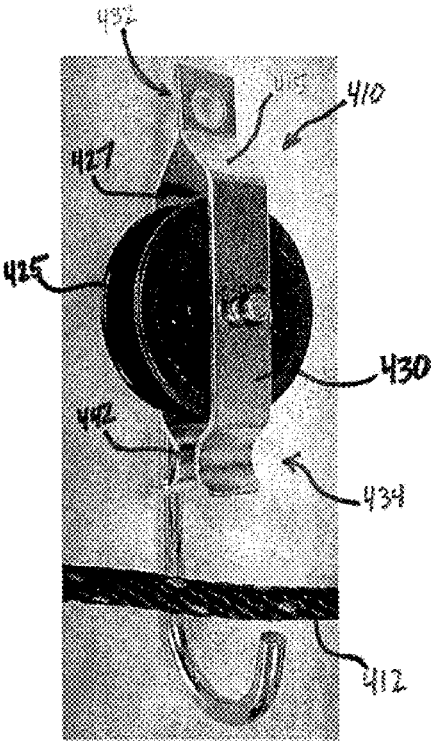
FIGS. 4A-4D are isometric views of a pulley apparatus like that of FIGS. 1-3 in connection with a rope.
Figure 4B:
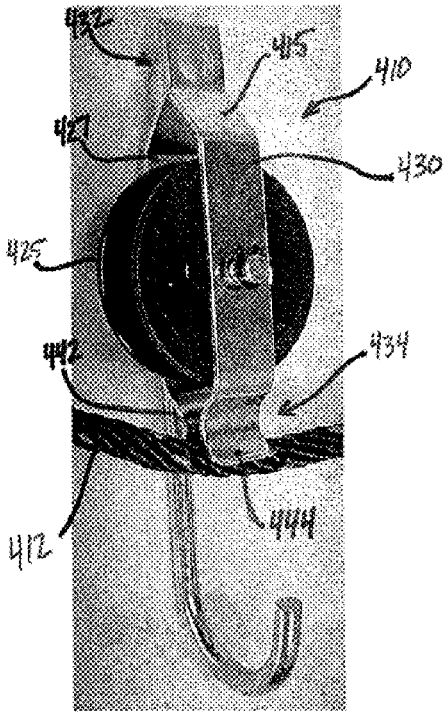
Figure 4C:
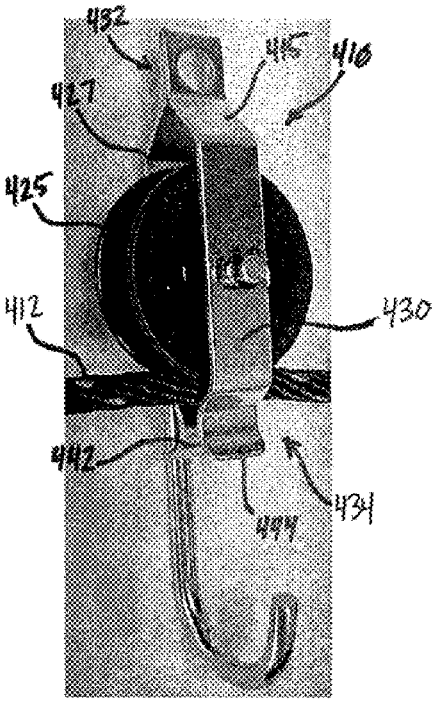
Figure 4D:
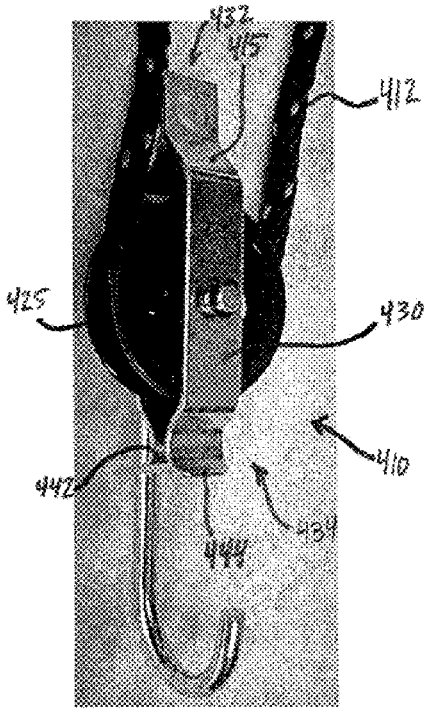

As noted, FIGS. 4A-4D illustrate how a length of rope 412 can be inserted into the pulley apparatus 410. FIG. 4B shows how the entrance portion can be configured to channel the rope 412 toward the restrictor portion upon entrance into the pulley apparatus 410. The restrictor portion can be configured to inhibit rope channeled to it from passing therethrough. In some embodiments, the support structure 415 is configured to hingedly flex, with the first support structure end section 432 serving as a hinge and the first and second segments 442, 444 being configured to be pressed apart. In some such embodiments, the rope 412 can press the first and second segments 442, 444 apart to pass through the restrictor portion. As shown in FIGS. 4C-4D, the rope 412 can engage the wheel 425 and be moved into an operational position.

To remove the rope 412 from the pulley apparatus 412, the process previously discussed can be reversed. The rope 412 can be removed from the operational position and disengaged from the wheel 425. The exit portion can be configured to channel the rope 412 toward the restrictor portion upon exit from the pulley apparatus 412. The rope 412 can be pulled through the restrictor portion, thereby removing the rope 412 from the pulley apparatus 412. The restrictor portion can inhibit the rope 412 from being accidentally removed from the pulley apparatus 412, which can be beneficial during setup and/or operation of the pulley apparatus 412. In many embodiments, an operator must intentionally pull the rope 412 through the restrictor portion in order to remove the rope 412 from the pulley apparatus 412.

Referring again to FIGS. 1-3, in some embodiments, the pulley apparatus 10 can include a hook assembly 20 coupled to the support structure 15. The hook assembly 20 can be configured to hang the pulley apparatus 10 from an object (e.g., a tie-down tensioning device, as is discussed elsewhere herein) and/or to hang an object (e.g., some type of weight) from the pulley apparatus 10. The hook assembly 20 can include a hook 50 configured to hook the pulley apparatus 10 to the object and/or to hook the object to the pulley apparatus 10. The hook assembly 20 can include a wheel axle 55 extending between the first and second opposed side members 27, 30 of the support structure 15. The hook assembly 20 can include a shaft 60 connected on one end to the pulley hook 50 and on an opposed end to the wheel axle 55. In some embodiments, all of the hook assembly 20 is integrally formed of the same material (e.g., by bending a metal rod into a desired shape). In many embodiments, the hook 50 of the hook assembly 20 is positioned opposite the first end section 32 of the support structure 15.

Figure 5:
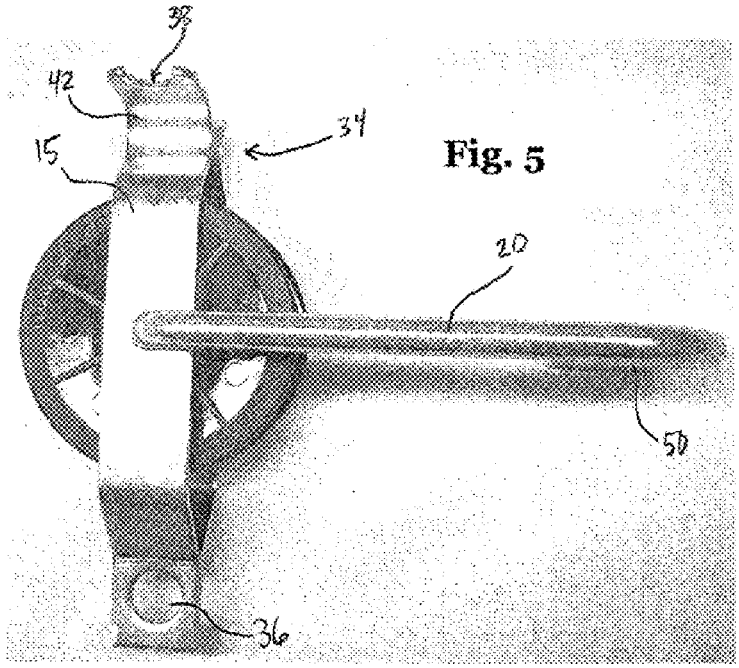
FIG. 5 is a front view of the pulley apparatus of FIG. 1, with the hook assembly being rotated relative to the support structure.

Referring now to FIG. 5, in some embodiments, the hook assembly is rotatable relative to the support structure 15 about the axis (61 in FIG. 2) defined by the wheel axle (55 in FIGS. 2-3). The hook assembly 20 can be released from the hook assembly anchor 38 of the support structure 15 and rotated to any desired position. In many instances, this rotatability can make assembly of the pulley apparatus 10 significantly easier, with one step being inserting the wheel axle 55 into the first side member 27, into the central bore 63 of the wheel (discussed further elsewhere herein), and out of the second side member 30, another step being securing the wheel axle 55 (e.g., with clipping mechanism 26) to prevent the hook assembly 20 from disengaging, and a third step being rotating the hook assembly 20 to engage the hook assembly anchor 38. Assembly in this manner can be considerably easier in terms of alignment of the various components. If the desired position of the hook assembly 20 is 180 degrees opposite from the support structure aperture 36 (which is often the case), the hook assembly 20 can engage the hook assembly anchor 38, according to some preferred embodiments. The hook assembly anchor 38 (which is often part of the first segment 42 of the rope channeling structure 34) of the support structure 15 is configured to align the hook 50 of the hook assembly 20 opposite the aperture 36 of the support structure 15.

Referring again to FIGS. 1-3, the pulley apparatus 10 can include a wheel 25, which can be positioned between the first and second opposed side members 27, 30 of the support structure 15. The wheel 25 can be configured to rotate about the axis 61 defined by the wheel axle 55 of the hook assembly 20. The wheel can include a central bore 63 interfacing with the wheel axle 55 of the hook assembly 20. The wheel 25 can include a groove 64 extending around a circumference of the wheel 25 and being configured to receive rope (as is shown in FIGS. 4A-4B).

Figure 6A:
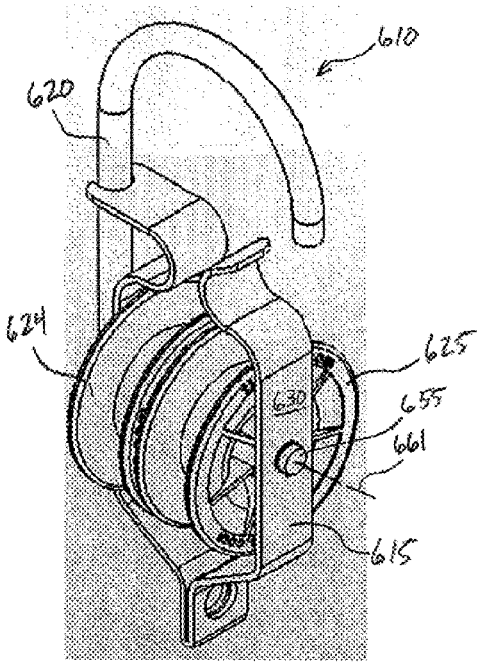
FIGS. 6A-6B are an isometric view and a side view, respectively, of a pulley apparatus according to embodiments of the present invention.
Figure 6B:
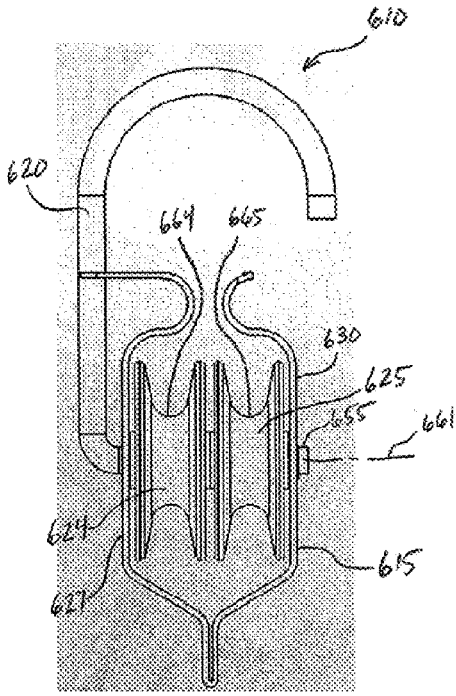

FIGS. 6A-6B show a pulley apparatus 610 according to embodiments of the present invention. In many ways, the pulley apparatus 610 of FIGS. 6A-6B is similar to the pulley apparatus 10 of FIGS. 1-3 and the pulley apparatus 410 of FIGS. 4A-4D. Referring again to FIGS. 6A-6B, the pulley apparatus 610 can include a support structure 615 (such as those discussed elsewhere herein), a hook assembly 620 (such as those discussed elsewhere herein), and two wheels 624, 625 (such as those discussed elsewhere herein). As shown, both wheels 624, 625 are positioned between the first and second opposed side members 627, 630 of the support structure 615. Both wheels 624, 625 can be configured to rotate about the axis 661 defined by the wheel axle 655 of the hook assembly 620. In many embodiments, both wheels 624, 625 include a central bore that interfaces with the wheel axle 655 of the hook assembly 620. In many embodiments, both wheels 624, 625 include a groove 664, 665 extending around a circumference of the wheel 624, 625 and being configured to receive rope. Although two wheels 624, 625 are shown, pulley apparatuses according to embodiments of the present invention can include one wheel, two wheels, three wheels, four wheels, or any suitable number of wheels, depending on the particular application.

Figure 7:
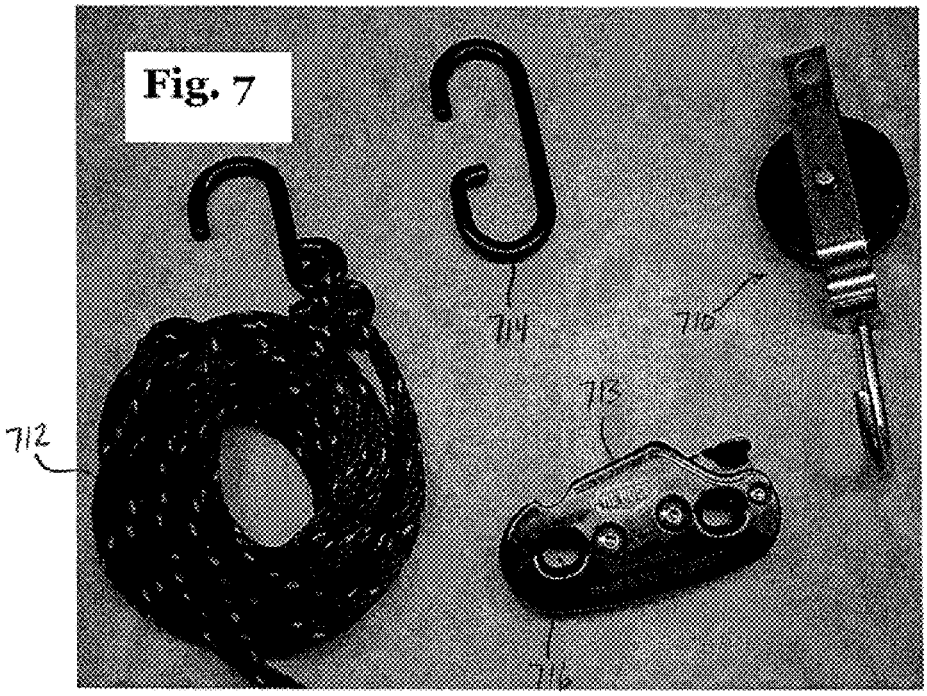
FIG. 7 is a top view of a block-and-tackle kit according to embodiments of the present invention.

FIG. 7 shows a block-and-tackle kit according to embodiments of the present invention. The kit can include a length of rope 712, one or more pulley apparatuses 710 (such as those discussed elsewhere herein), a tie-down tensioning device 713, and a tie-down hook 714. As is discussed in greater detail elsewhere herein, the tie-down hook 714 can be adapted to hook into a second tie-down aperture 716. In some embodiments, the kit can include instructions for creating a block-and-tackle out of the rope 712, the pulley apparatus(es) 710, the tie-down tensioning device 713, and the tie-down hook 714, according to methods discussed elsewhere herein and/or other suitable methods. Although one pulley apparatus is shown, block-and-tackle kits according to embodiments of the present invention can include one pulley apparatus, two pulley apparatuses, three pulley apparatuses, four pulley apparatuses, or any suitable number of pulley apparatuses, depending on the particular application.

Figure 8:
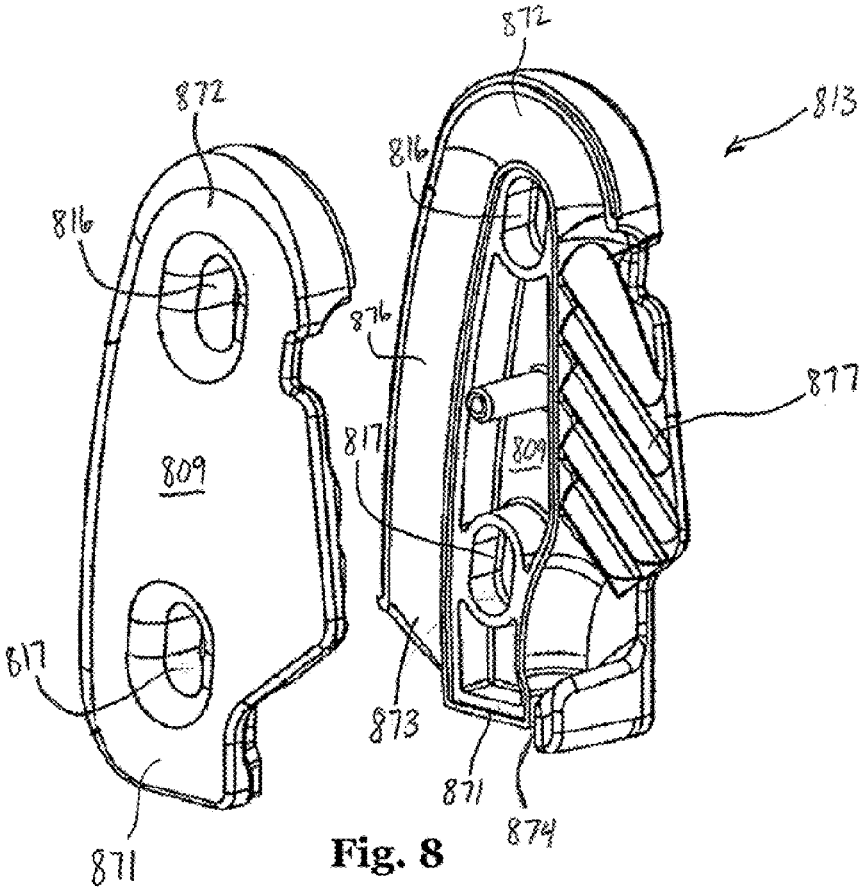
FIG. 8 is an exploded view of a tie-down tensioning device that can be implemented in embodiments of the present invention.

FIG. 8 shows an illustrative tie-down tensioning device 813 (split open to expose the interior) that can be used in block-and-tackles according to embodiments of the present invention. In many embodiments, the tie-down tensioning device 813 can include a housing 809. The housing 809 can include first and second housing end sections 871, 872. The first housing end section 871 can define a first tie-down aperture 817. In many embodiments, the pulley apparatus's pulley hook (50 of FIGS. 1-3) can be configured to hook into the first tie-down aperture 817. The second opposed housing end section 872 can define a second tie-down aperture 816. In some embodiments, the housing 809 can include both a rope inlet 873 and a rope outlet 874 in the first housing end section 871. In many embodiments, the housing 809 can include a rope path 876 from the rope inlet 873 to the rope outlet 874. In some such embodiments, the rope path 876 can pass through the second housing end section 872 around the second tie-down aperture 816 and/or through a clam cleat 877. Tie-down tensioning devices such as those discussed herein are described in greater detail in U.S. Pat. No. 7,428,769 (titled "Tie Down Tensioning Device" and assigned to Tie Boss LLC, the owner of the present invention), which is hereby incorporated by reference herein in its entirety.

FIGS. 9A-9C and 10A-10C show methods of creating a block-and-tackle according to embodiments of the present invention. A block-and-tackle can provide a mechanical advantage in lifting and/or lowering objects with a rope. An object can be lifted and/or lowered via the exertion of a force that is less than the weight of the object, provided that the force is applied over a longer distance. In many embodiments of the present invention, an object can be lifted (and/or lowered) by pulling a longer length of rope than would ordinarily be required with a force that is less than the weight of the object. Some methods of creating a block-and-tackle involve providing one or more pulley apparatuses (such as those discussed elsewhere herein) and a tie-down tensioning device (such as those discussed elsewhere herein).

In some embodiments, methods of creating a block-and-tackle can include feeding a leading end 951 of a rope 912 through the tie-down tensioning device 913. As is discussed elsewhere herein, in many embodiments, feeding a leading end 951 of a rope 912 through the tie-down tensioning device 913 involves feeding the leading end of the rope into the rope inlet, along the rope path, and out through the rope outlet. Most methods of creating a block-and-tackle further include fixing the tie-down tensioning device 913 to a stationary object (e.g., via tie-down hook 914). The tie-down tensioning device 913 (including the clam cleat—877 in FIG. 8) can aid in the pulling of the rope by inhibiting slippage.

Many methods of creating a block-and-tackle according to embodiments of the present invention involve introducing an intermediate portion 953 of a trailing end 952 of the rope 912 to a first pulley apparatus 910. As is discussed elsewhere herein, in many embodiments, introducing the intermediate portion 953 of the trailing end 952 of the rope 912 to the first pulley apparatus 910 involves contacting the entrance portion of the rope channeling structure with the rope, pressing the rope past the restrictor portion of the rope channeling structure, and positioning the rope in the first-wheel groove (see FIGS. 3, 4A-4D and corresponding discussion for additional detail).

Figure 9A:
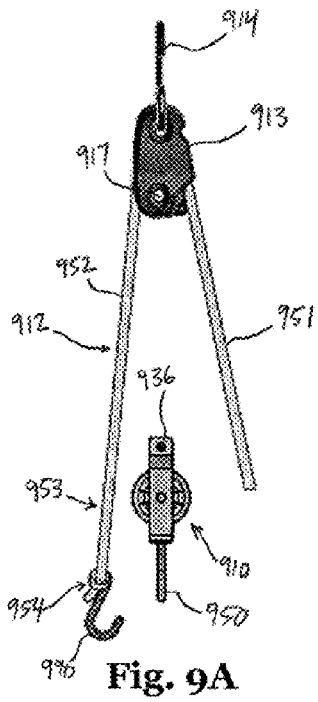
FIGS. 9A-9C illustrate a method of creating a block-and-tackle according to embodiments of the present invention.
Figure 9B:
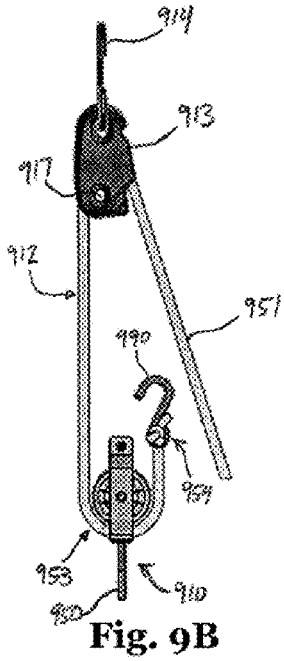
Figure 9C:
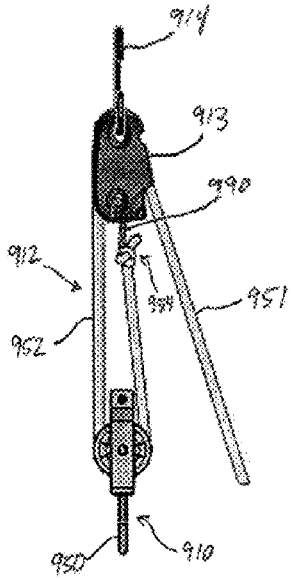

In many embodiments, methods of creating a block-and-tackle can include securing an end portion 954 of the trailing end 952 of the rope 912. The end portion 954 of the trailing end 952 of the rope 912 can be affixed to a rope hook 990. FIG. 9C shows how the end portion 954 of the trailing end 952 of the rope 912 can be secured by hooking the rope hook 990 into the first tie-down aperture 917 of the tie-down tensioning device 913. With the end portion 954 of the trailing end 952 of the rope 912 being secured in the embodiment of FIG. 9C, an object to be lifted can be coupled to the first pulley apparatus 910 (e.g., it can be hooked onto the hook 950 or the first pulley apparatus 910 can be oriented with the hook 950 pointed up (or rotated relative to the support structure) and the object can be hooked into the pulley aperture 936). The leading end 951 of the rope 912 can be pulled, which can cause the first pulley apparatus 910, and the attached object, to move upwardly. Pulling the rope 912 a distance of x will cause the object to move upwardly by a distance of roughly x/2. If the object weighs y pounds, the rope 912 must be pulled with a force of y/2 pounds in order to lift the object.

Figure 10A:
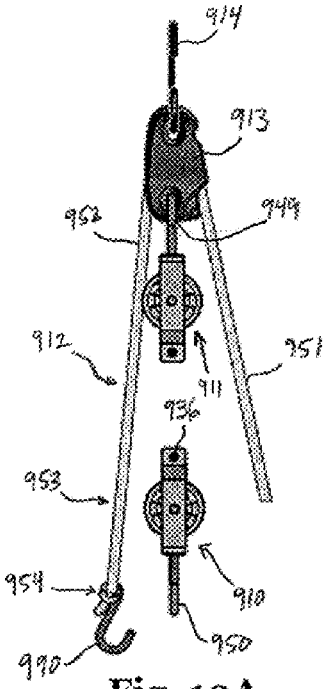
FIGS. 10A-10C illustrate a method of creating a block-and-tackle according to embodiments of the present invention.
Figure 10B:
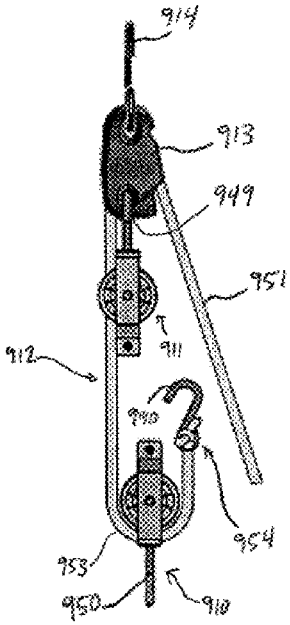
Figure 10C:
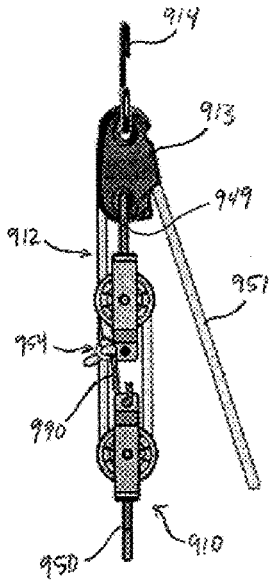

The method of creating a block-and-tackle illustrated in FIGS. 10A-10C involves multiple pulley apparatuses 910, 911. As shown, the method can include hooking the pulley hook 949 of a second pulley apparatus 911 into the first tie-down aperture 917 of the tie-down tensioning device 913. In this way, the pulley apparatuses 910, 911 can be oriented oppositely of one another in an operational block-and-tackle. After introducing the intermediate portion 953 of the trailing end 952 of the rope 912 to the first pulley apparatus 910 (see discussion elsewhere herein), a portion of the trailing end 952 of the rope 912 that is between the intermediate portion 953 and the end portion 954 can be introduced to the second pulley apparatus 911. For example, as is discussed elsewhere herein, such introduction can involve contacting the entrance portion of the rope channeling structure with the rope, pressing the rope past the restrictor portion of the rope channeling structure, and positioning the rope in the groove (see FIGS. 3, 4A-4D and corresponding discussion for additional detail).

As noted, methods of creating a block-and-tackle can include securing an end portion 954 of the trailing end 952 of the rope 912. FIG. 10C shows how the end portion 954 of the trailing end 952 of the rope 912 can be secured by hooking the rope hook 990 into the pulley aperture 936 of the first pulley apparatus 910. In some embodiments, the first pulley apparatus 910 can be weighted such that its pulley hook 950 naturally hangs downwardly and its pulley aperture 936 is oriented upwardly, thereby aiding in hooking the rope hook 990 into the pulley aperture 936 of the first pulley apparatus 910. With the end portion 954 of the trailing end 952 of the rope 912 being secured in the embodiment of FIG. 10C, an object to be lifted can be coupled to the first pulley apparatus 910 (e.g., it can be hooked onto the hook 950). The leading end 951 of the rope 912 can be pulled, which can cause the first pulley apparatus 910, and the attached object, to move upwardly. Pulling the rope 912 a distance of x will cause the object to move upwardly by a distance of roughly x/3. If the object weighs y pounds, the rope 912 must be pulled with a force of y/3 pounds in order to lift the object.

Figure 11:
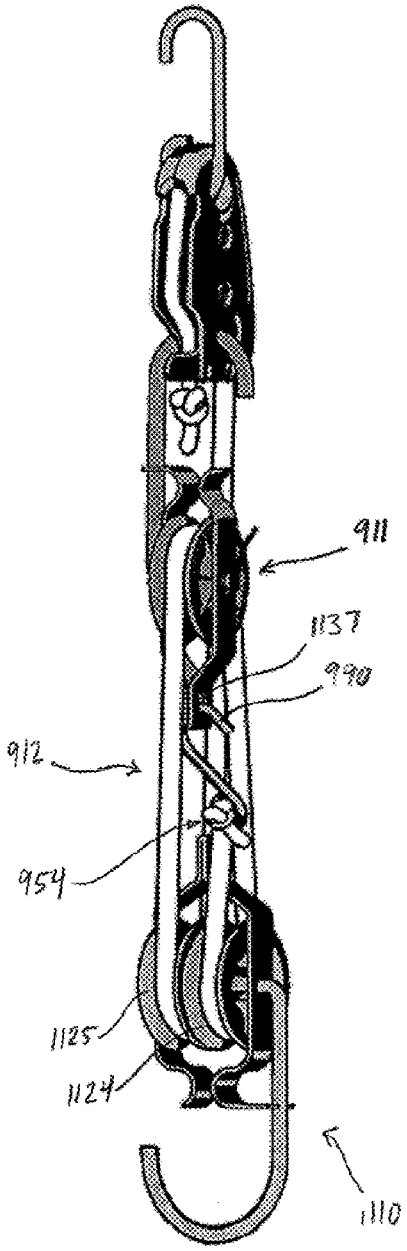
FIG. 11 is an isometric view of a block-and-tackle according to embodiments of the present invention.

As shown in FIG. 11, the first pulley apparatus 1110 can include a second wheel (like the two-wheel pulley discussed in connection with FIGS. 6A-6B). After the rope 912 has been introduced to the first pulley apparatus 1110 and then the second pulley apparatus 911 (as is discussed elsewhere herein), the rope 912 can be re-introduced to the first pulley apparatus 1110. Specifically, a portion of the trailing end of the rope 912 that is between the portion that was introduced to the second pulley apparatus 911 and the end portion 954 can be re-introduced to the first pulley apparatus 1110. The rope 912 can be positioned into contact with the entrance portion of the rope channeling structure, and then pressed past the restrictor portion of the rope channeling structure, and then positioned in the second-wheel groove of the first pulley apparatus 1110. In such a block-and-tackle configuration, the rope hook 990 affixed to the end portion 954 of the trailing end of the rope 912 can be hooked into the pulley aperture 1137 of the second pulley apparatus 911 to secure the end portion 954 of the trailing end of the rope 912. The leading end of the rope 912 can be pulled, which can cause the first pulley apparatus 1110, and an object attached thereto, to move upwardly. Pulling the rope 912 a distance of x will cause the object to move upwardly by a distance of roughly x/4. If the object weighs y pounds, the rope 912 must be pulled with a force of y/4 pounds in order to lift the object.

Figure 12:
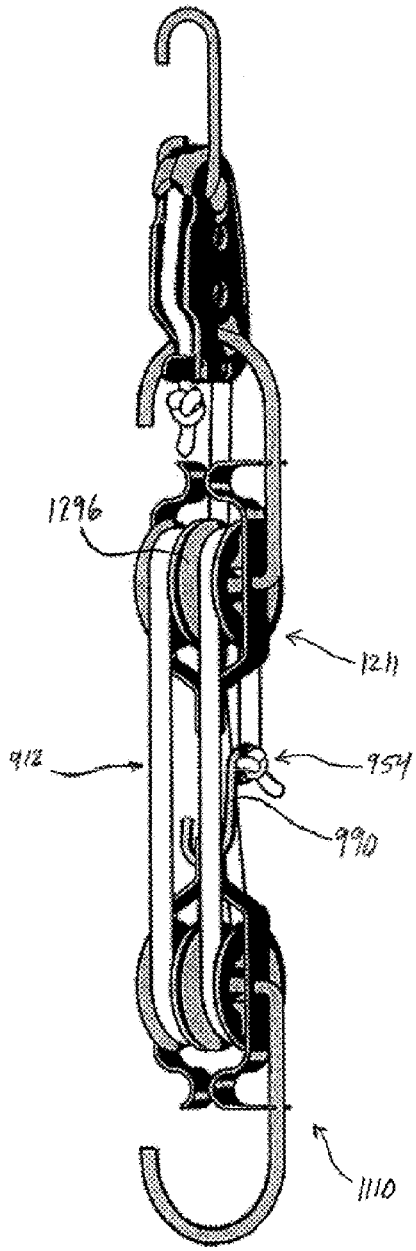
FIG. 12 is an isometric view of a block-and-tackle according to embodiments of the present invention.

As shown in FIG. 12, the second pulley apparatus 1211 can likewise include a second wheel 1296 (like the two-wheel pulley discussed in connection with FIGS. 6A-6B). After the rope 912 has been introduced to the first pulley apparatus 1110 and then the second pulley apparatus 1211 and then re-introduced to the first pulley apparatus 1110 (as are discussed elsewhere herein), the rope 912 can be re-introduced to the second pulley apparatus 1211. Specifically, a portion of the trailing end of the rope 912 that is between the portion that was re-introduced to the first pulley apparatus 1110 and the end portion 954 can be re-introduced to the second pulley apparatus 1211. The rope 912 can be positioned into contact with the entrance portion of the rope channeling structure, and then pressed past the restrictor portion of the rope channeling structure, and then positioned in the second-wheel groove of the second pulley apparatus 1211. In such a block-and-tackle configuration, the rope hook 990 affixed to the end portion 954 of the trailing end of the rope 912 can be hooked into the pulley aperture of the first pulley apparatus 1110 to secure the end portion 954 of the trailing end of the rope 912. The leading end of the rope 912 can be pulled, which can cause the first pulley apparatus 1110, and an object attached thereto, to move upwardly. Pulling the rope 912 a distance of x will cause the object to move upwardly by a distance of roughly x/5. If the object weighs y pounds, the rope 912 must be pulled with a force of y/5 pounds in order to lift the object.

Certain block-and-tackle configurations are provided in the drawings, but embodiments of the present invention can include block-and-tackle configurations that are not shown. For example, block-and-tackle configurations according to embodiments of the present invention can include one, two, three, four, or more pulley apparatuses. Pulley apparatuses used in block-and-tackle configurations according to embodiments of the present invention can include one, two, three, four, or more wheels. In some embodiments, all of the pulley apparatuses used in block-and-tackle configurations have the same number of wheels. In some embodiments, one or more of the pulley apparatuses used in a block-and-tackle configuration have a different number of wheels than one or more of the other pulley apparatuses used in the block-and-tackle configuration. The number of pulley apparatuses and the number of wheels per pulley apparatus often depends on factors such as the amount of force a user is likely able/willing to exert, an optimum length of rope to be used, the desired simplicity/complexity of the block-and-tackle configuration, and so on.

In the foregoing detailed description, the invention has been described with reference to specific embodiments. However, it may be appreciated that various modifications and changes can be made without departing from the scope of the invention as set forth in the appended claims. Thus, some of the features of preferred embodiments described herein are not necessarily included in preferred embodiments of the invention which are intended for alternative uses.

What is claimed is:

1. A pulley apparatus, comprising:

(a) a support structure including (i) a first end section, (ii) a second opposed end section including a rope channeling structure, and (iii) first and second opposed side members extending between the first and second end sections, wherein the rope channeling structure includes a first segment extending from the first side member and a second segment extending from the second side member, the first and second segments together defining an entrance portion, an exit portion, and a narrower restrictor portion, with the entrance portion being configured to channel rope toward the restrictor portion upon entrance into the pulley apparatus, the exit portion being configured to channel rope toward the restrictor portion upon exit from the pulley apparatus, and the restrictor portion being configured to inhibit rope channeled to it from passing therethrough;

(b) a hook assembly coupled to the support structure, the hook assembly including (i) a hook configured to hook the pulley apparatus to an object, (ii) a wheel axle extending between the first and second opposed side members of the support structure, and (iii) a shaft connected on one end to the hook and on an opposed end to the wheel axle; and (c) a first wheel positioned between the first and second opposed side members of the support structure and configured to rotate about an axis defined by the wheel axle of the hook assembly, the first wheel including (i) a first-wheel central bore interfacing with the wheel axle of the hook assembly and (ii) a first-wheel groove extending around a circumference of the first wheel and being configured to receive rope.

2. The pulley apparatus of claim 1, wherein all of the support structure is integrally formed of the same material and wherein all of the hook assembly is integrally formed of the same material.

3. The pulley apparatus of claim 1, wherein the first and second segments of the rope channeling structure curve toward one another from the respective side members in defining the exit portion and curve back away from one another in defining the entrance portion, with the restrictor portion including a location at which the first segment is nearest the second segment.

4. The pulley apparatus of claim 1, wherein the support structure is configured to hingedly flex, with the first end section serving as a hinge and the first and second segments being configured to be pressed apart by rope to enable passage through the restrictor portion.

5. The pulley apparatus of claim 1, wherein the hook assembly is rotatable relative to the support structure about the axis defined by the wheel axle.

6. The pulley apparatus of claim 5, wherein the first end section of the support structure defines an aperture and wherein the support structure further includes (iv) a hook assembly anchor configured to align the hook of the hook assembly opposite the aperture of the support structure.

7. The pulley apparatus of claim 1, wherein the first end section of the support structure defines an aperture and wherein the hook of the hook assembly is positioned opposite the first end section of the support structure.

8. The pulley apparatus of claim 1, further comprising a second wheel positioned between the first wheel and one of the first and second opposed side members of the support structure and configured to rotate about the axis defined by the wheel axle of the hook assembly, the second wheel including (i) a second-wheel central bore interfacing with the wheel axle of the hook assembly and (ii) a second-wheel groove extending around a circumference of the second wheel and being configured to receive rope.

9. A block-and-tackle kit, comprising:

(a) a length of rope;

(b) a first pulley apparatus that includes:

(i) a support structure including (A) a first support structure end section, (B) a second opposed support structure end section including a rope channeling structure, and (C) first and second opposed side members extending between the first and second end sections, wherein the rope channeling structure includes a first segment extending from the first side member and a second segment extending from the second side member, the first and second segments together defining an entrance portion, an exit portion, and a narrower restrictor portion, with the entrance portion being configured to channel the rope toward the restrictor portion upon entrance into the first pulley apparatus, the exit portion being configured to channel the rope toward the restrictor portion upon exit from the first pulley apparatus, and the restrictor portion being configured to inhibit the rope channeled to it from passing therethrough, (ii) a hook assembly coupled to the support structure, the hook assembly including (A) a pulley hook, (B) a wheel axle extending between the first and second opposed side members of the support structure, and (C) a shaft connected on one end to the pulley hook and on an opposed end to the wheel axle, and (iii) a first wheel positioned between the first and second opposed side members of the support structure and configured to rotate about an axis defined by the wheel axle of the hook assembly, the first wheel including (A) a first-wheel central bore interfacing with the wheel axle of the hook assembly and (B) a first-wheel groove extending around a circumference of the first wheel and being configured to receive the rope;

(c) a tie-down tensioning device that includes (i) a first housing end section defining a first tie-down aperture, the pulley hook of the first pulley apparatus being configured to hook into the first tie-down aperture, (ii) a second opposed housing end section defining a second tie-down aperture, (iii) a rope inlet in the first housing end section, (iv) a rope outlet in the first housing end section, and (v) a rope path from the rope inlet, through the second housing end section around the second tie-down aperture, through a clam cleat, and to the rope outlet; and (d) a tie-down hook adapted to hook into the second tie-down aperture.

10. The block-and-tackle kit of claim 9, wherein the first and second segments of the first pulley apparatus's rope channeling structure curve toward one another from the respective side members in defining the exit portion and curve back away from one another in defining the entrance portion, with the restrictor portion including a location at which the first segment is nearest the second segment.

11. The block-and-tackle kit of claim 9, wherein the first pulley apparatus's support structure is configured to hingedly flex, with the first support structure end section serving as a hinge and the first and second segments being configured to be pressed apart by the rope to enable passage through the restrictor portion.

12. The block-and-tackle kit of claim 9, wherein the first support structure end section of the first pulley apparatus defines a pulley aperture and wherein the pulley hook of the first pulley apparatus is positioned opposite the first support structure end section of the first pulley apparatus, the block-and-tackle kit further comprising:

(e) a second pulley apparatus that includes:

(i) a support structure including (A) a first support structure end section, (B) a second opposed support structure end section including a rope channeling structure, and (C) first and second opposed side members extending between the first and second end sections, wherein the rope channeling structure includes a first segment extending from the first side member and a second segment extending from the second side member, the first and second segments together defining an entrance portion, an exit portion, and a narrower restrictor portion, with the entrance portion being configured to channel the rope toward the restrictor portion upon entrance into the second pulley apparatus, the exit portion being configured to channel the rope toward the restrictor portion upon exit from the second pulley apparatus, and the restrictor portion being configured to inhibit the rope channeled to it from passing therethrough, (ii) a hook assembly coupled to the support structure, the hook assembly including (A) a pulley hook configured to hook into the pulley aperture of the first pulley apparatus, (B) a wheel axle extending between the first and second opposed side members of the support structure, and (C) a shaft connected on one end to the hook and on an opposed end to the wheel axle, and (iii) a first wheel positioned between the first and second opposed side members of the support structure and configured to rotate about an axis defined by the wheel axle of the hook assembly, the first wheel including (A) a first-wheel central bore interfacing with the wheel axle of the hook assembly and (B) a first-wheel groove extending around a circumference of the first wheel and being configured to receive the rope.

13. The block-and-tackle kit of claim 12, wherein either the first pulley apparatus or the second pulley apparatus further includes (iv) a second wheel positioned between the first wheel and one of the first and second opposed side members of the support structure and configured to rotate about the axis defined by the wheel axle of the hook assembly, the second wheel including (A) a second-wheel central bore interfacing with the wheel axle of the hook assembly and (B) a second-wheel groove extending around a circumference of the second wheel and being configured to receive the rope.

14. The block-and-tackle kit of claim 9, wherein the first pulley apparatus further includes (iv) a second wheel positioned between the first wheel and one of the first and second opposed side members of the support structure and configured to rotate about the axis defined by the wheel axle of the hook assembly, the second wheel including (A) a second-wheel central bore interfacing with the wheel axle of the hook assembly and (B) a second-wheel groove extending around a circumference of the second wheel and being configured to receive the rope.

15. The block-and-tackle kit of claim 9, further comprising (e) instructions for creating a block-and-tackle out of the rope, the first pulley apparatus, the tie-down tensioning device, and the tie-down hook.

16. A method of creating a block-and-tackle, the method comprising:

(a) providing a first pulley apparatus that includes:

(i) a support structure including (A) a first support structure end section, (B) a second opposed support structure end section including a rope channeling structure, and (C) first and second opposed side members extending between the first and second end sections, wherein the rope channeling structure includes a first segment extending from the first side member and a second segment extending from the second side member, the first and second segments together defining an entrance portion, an exit portion, and a narrower restrictor portion, (ii) a hook assembly coupled to the support structure, the hook assembly including (A) a pulley hook, (B) a wheel axle extending between the first and second opposed side members of the support structure, and (C) a shaft connected on one end to the pulley hook and on an opposed end to the wheel axle, and (iii) a first wheel positioned between the first and second opposed side members of the support structure and configured to rotate about an axis defined by the wheel axle of the hook assembly, the first wheel including (A) a first-wheel central bore interfacing with the wheel axle of the hook assembly and (B) a first-wheel groove extending around a circumference of the first wheel;

(b) providing a tie-down tensioning device that includes (i) a first housing end section defining a first tie-down aperture, (ii) a second opposed housing end section defining a second tie-down aperture, (iii) a rope inlet in the first housing end section, (iv) a rope outlet in the first housing end section, and (v) a rope path from the rope inlet, through the second housing end section around the second tie-down aperture, through a clam cleat, and to the rope outlet;

(c) feeding a leading end of a rope through the tie-down tensioning device by feeding the leading end of the rope into the rope inlet, along the rope path, and out through the rope outlet;

(d) fixing the tie-down tensioning device to a stationary object;

(e) introducing an intermediate portion of a trailing end of the rope to the first pulley apparatus by contacting the entrance portion of the rope channeling structure with the rope, pressing the rope past the restrictor portion of the rope channeling structure, and positioning the rope in the first-wheel groove; and (f) securing an end portion of the trailing end of the rope to create the block-and-tackle.

17. The method of claim 16, wherein the end portion of the trailing end of the rope is affixed to a rope hook and securing the end portion of the trailing end of the rope comprises hooking the rope hook into the first tie-down aperture.

18. The method of claim 16, further comprising:

(g) providing a second pulley apparatus that includes:

(i) a support structure including (A) a first support structure end section, (B) a second opposed support structure end section including a rope channeling structure, and (C) first and second opposed side members extending between the first and second end sections, wherein the rope channeling structure includes a first segment extending from the first side member and a second segment extending from the second side member, the first and second segments together defining an entrance portion, an exit portion, and a narrower restrictor portion, (ii) a hook assembly coupled to the support structure, the hook assembly including (A) a pulley hook, (B) a wheel axle extending between the first and second opposed side members of the support structure, and (C) a shaft connected on one end to the pulley hook and on an opposed end to the wheel axle, and (iii) a first wheel positioned between the first and second opposed side members of the support structure and configured to rotate about an axis defined by the wheel axle of the hook assembly, the first wheel including (A) a first-wheel central bore interfacing with the wheel axle of the hook assembly and (B) a first-wheel groove extending around a circumference of the first wheel and being configured to receive the rope;

(h) hooking the pulley hook of the second pulley apparatus into the first tie-down aperture of the tie-down tensioning device; and (i) introducing a portion of the trailing end of the rope that is between the intermediate portion and the end portion to the second pulley apparatus by contacting the entrance portion of the rope channeling structure with the rope, pressing the rope past the restrictor portion of the rope channeling structure, and positioning the rope in the first-wheel groove.

19. The method of claim 18, wherein the first pulley apparatus's first support structure end section defines a pulley aperture, the end portion of the trailing end of the rope is affixed to a rope hook, and securing the end portion of the trailing end of the rope comprises hooking the rope hook into the first pulley apparatus's pulley aperture.

20. The method of claim 18, wherein the first pulley apparatus is weighted such that its pulley hook naturally hangs downwardly and its pulley aperture is oriented upwardly, thereby aiding in hooking the rope hook into the first pulley apparatus's pulley aperture.

21. The method of claim 18, wherein the first pulley apparatus further includes (iv) a second wheel positioned between the first wheel and one of the first and second opposed side members of the support structure and configured to rotate about the axis defined by the wheel axle of the hook assembly, the second wheel including (A) a second-wheel central bore interfacing with the wheel axle of the hook assembly and (B) a second-wheel groove extending around a circumference of the second wheel and being configured to receive the rope, and wherein the method further comprises (j) re-introducing a portion of the trailing end of the rope that is between the portion that was introduced to the second pulley apparatus and the end portion to the first pulley apparatus by contacting the entrance portion of the rope channeling structure with the rope, pressing the rope past the restrictor portion of the rope channeling structure, and positioning the rope in the second-wheel groove.

22. The method of claim 21, wherein the second pulley apparatus's first support structure end section defines a pulley aperture, the end portion of the trailing end of the rope is affixed to a rope hook, and securing the end portion of the trailing end of the rope comprises hooking the rope hook into the second pulley apparatus's pulley aperture.

23. The method of claim 21, wherein the second pulley apparatus further includes (iv) a second wheel positioned between the first wheel and one of the first and second opposed side members of the support structure and configured to rotate about the axis defined by the wheel axle of the hook assembly, the second wheel including (A) a second-wheel central bore interfacing with the wheel axle of the hook assembly and (B) a second-wheel groove extending around a circumference of the second wheel and being configured to receive the rope, and wherein the method further comprises (k) re-introducing a portion of the trailing end of the rope that is between the portion that was re-introduced to the first pulley apparatus and the end portion to the second pulley apparatus by contacting the entrance portion of the rope channeling structure with the rope, pressing the rope past the restrictor portion of the rope channeling structure, and positioning the rope in the second-wheel groove.

24. The method of claim 23, wherein the first pulley apparatus's first support structure end section defines a pulley aperture, the end portion of the trailing end of the rope is affixed to a rope hook, and securing the end portion of the trailing end of the rope comprises hooking the rope hook into the first pulley apparatus's pulley aperture.

25. The method of claim 16, wherein the first and second segments of the first pulley apparatus's rope channeling structure curve toward one another from the respective side members in defining the exit portion and curve back away from one another in defining the entrance portion, with the restrictor portion including a location at which the first segment is nearest the second segment.

26. The method of claim 16, wherein the first pulley apparatus's support structure is configured to hingedly flex and wherein pressing the rope past the restrictor portion of the rope channeling structure comprises pressing the first and second segments apart with the rope.

27. The method of claim 16, wherein the first pulley apparatus's first support structure end section defines a pulley aperture and wherein the first pulley apparatus's pulley hook is positioned opposite the first pulley apparatus's first support structure end section.

* * * * *